United States Patent [19]

Ketterer

[11] Patent Number: 4,522,133

[45] Date of Patent: Jun. 11, 1985

[54] FEED CONTROLLING ARRANGEMENT FOR BUTTON SEWING MACHINE

[75] Inventor: Stanley J. Ketterer, Jamesburg, N.J.

[73] Assignee: The Singer Company, Stamford, Conn.

[21] Appl. No.: 660,168

[22] Filed: Oct. 12, 1984

[51] Int. Cl.[3] ..... D05B 3/14

[52] U.S. Cl. ..... 112/112; 112/237

[58] Field of Search ..... 112/111, 112, 237, 169

[56] References Cited

U.S. PATENT DOCUMENTS

| | | | |
|---|---|---|---|
| 1,929,384 | 10/1933 | Becker . | |
| 2,735,387 | 2/1956 | Baehr et al. . | |
| 3,165,080 | 1/1965 | Castelletti . | |
| 3,450,077 | 6/1969 | Bonomo . | |
| 4,401,043 | 8/1983 | Peterson | 112/112 X |
| 4,463,695 | 8/1984 | Killinger | 112/112 X |
| 4,474,123 | 10/1984 | Ponte | 112/169 X |
| 4,480,564 | 11/1984 | Ponte | 112/112 X |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A button sewing machine is provided on a fabric and button positioning plate with a thread supporting tongue to extend longitudinally in a needle hole into engagement with the underside of fabric and enable thread to be sewn under and across the tongue to prevent the fabric from slipping on the plate during a button sewing operation.

5 Claims, 9 Drawing Figures

Fig. 7
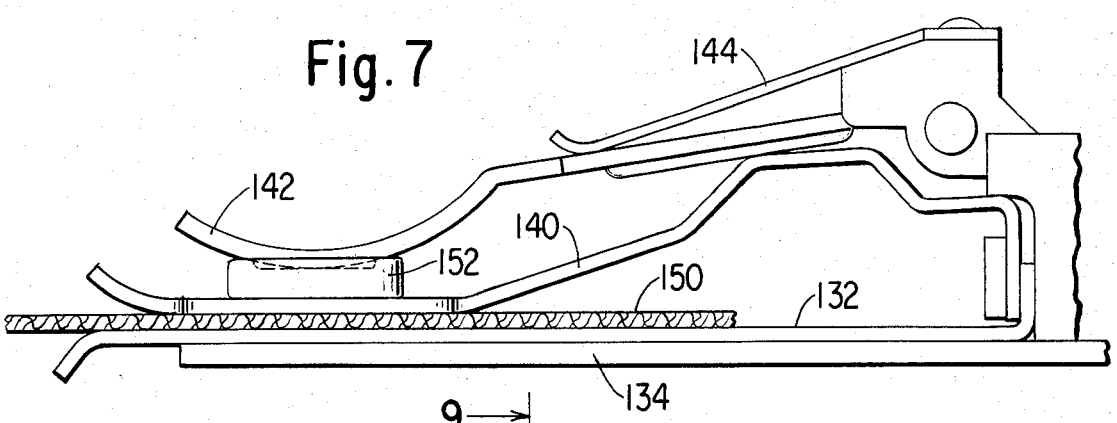
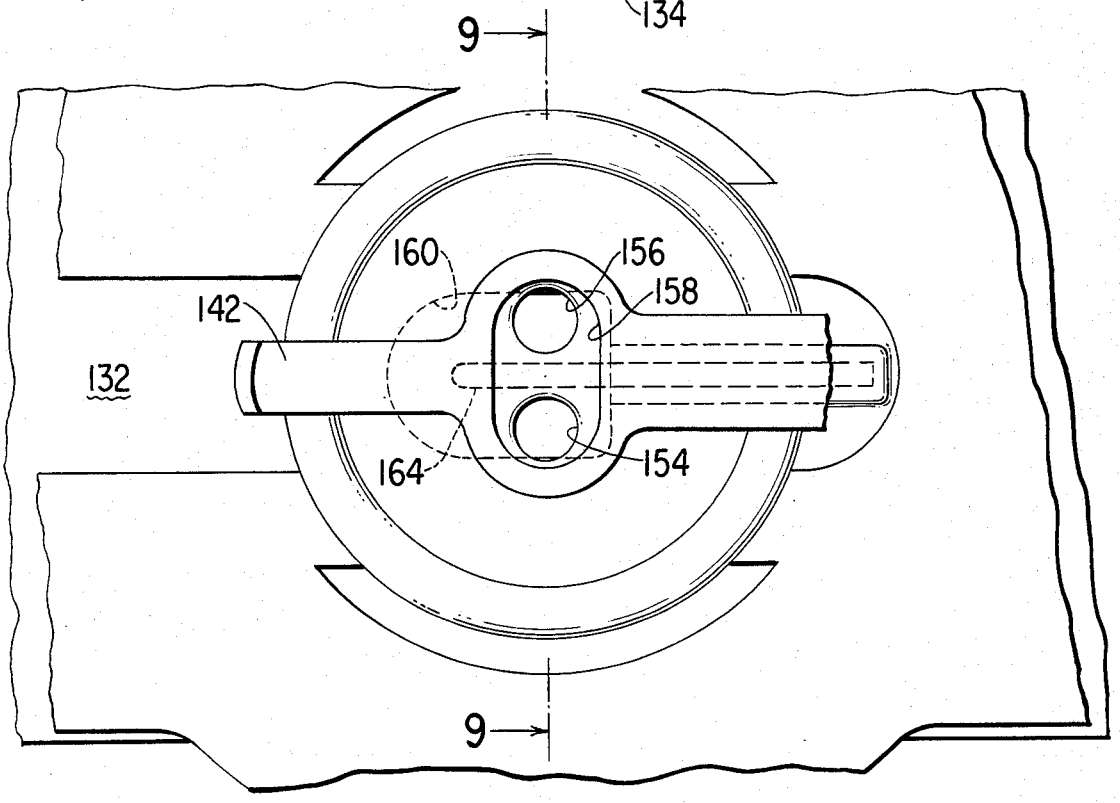
Fig. 8
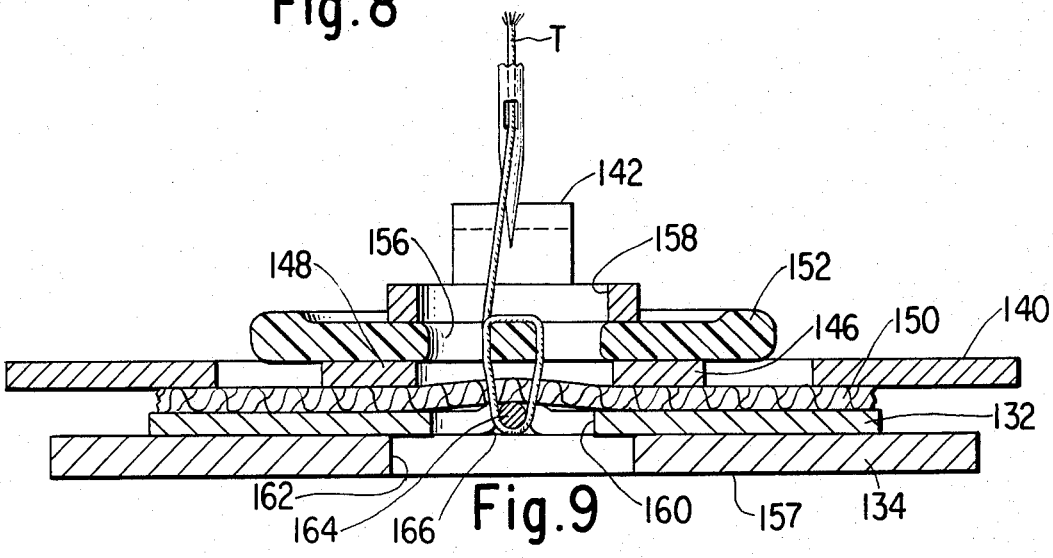
Fig. 9

FEED CONTROLLING ARRANGEMENT FOR BUTTON SEWING MACHINE

DESCRIPTION

BACKGROUND OF THE INVENTION

1. Field of the Invention

The invention relates to button sewing machines of a kind wherein a fabric workpiece and a button are moved from side to side by a feeding plate into positions permitting the button to be sewn to the fabric through spaced apart holes in the button.

2. Description of the Prior Art

A button sewing machine of the described type as shown, for example, in the copending patent application of Gary W. Ponte for "Work Clamp Shifting Mechanism for Sewing Machines", Ser. No. 488,904, filed Apr. 27, 1983, U.S. Pat. No. 4,474,123 may be seen as including means for clamping fabric and a button to a feeding plate for movement thereby. Nevertheless, it has been found that proper feeding of the fabric and button as required for the sewing operation does not always occur because of slippage by the fabric on the feeding plate. It has also been found that "flagging" (needle following movement of the fabric) will occur at times due to inadequate support for the fabric at the needle hole in the feeding plate.

It is a prime object of the invention to assure the feeding of fabric and a button on a button sewing machine as required for the performance of a button sewing operation.

It is also an object of the invention to prevent flagging during a button sewing operation on a button sewing machine.

Other objects and advantages of the invention will become apparent during a reading of the specification taken in connection with the accompanying drawings.

SUMMARY OF THE INVENTION

A button sewing machine according to the invention includes a movable fabric supporting plate with a needle hole therein, means for clamping the fabric and a button to the plate for movement thereby into positions wherein the button may be sewn to the fabric through spaced apart holes in the button, and a thread supporting tongue located on the plate in a position to extend longitudinally in the needle hole into engagement with the underside of the clamped fabric and enable thread to be sewn across the finger to prevent the fabric from slipping on the supporting plate during a button sewing operation.

DESCRIPTION OF THE DRAWINGS

FIG. 7 is a side view of the clamping mechanism showing fabric and a button being held thereby;

FIG. 8 is a fragmentary top view showing a button hold down portion of the clamping mechanism; and, FIG. 9 is a sectional view taken on the plane of the line 9—9 of FIG. 8 through a needle hole in the fabric feeding plate of the machine and showing fabric and a button thereon.

DESCRIPTION OF THE INVENTION

Figure 1:
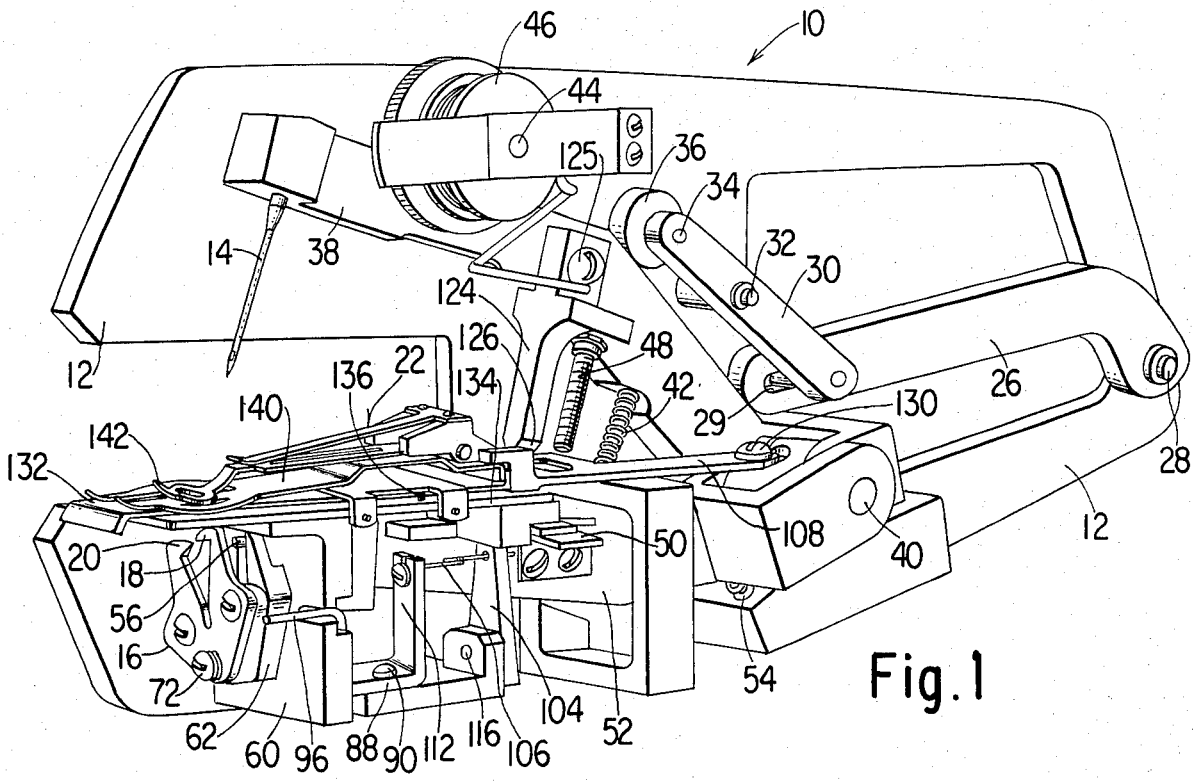
FIG. 1 is a side perspective view of a button sewing machine including the arrangement of the invention.
Figure 2:
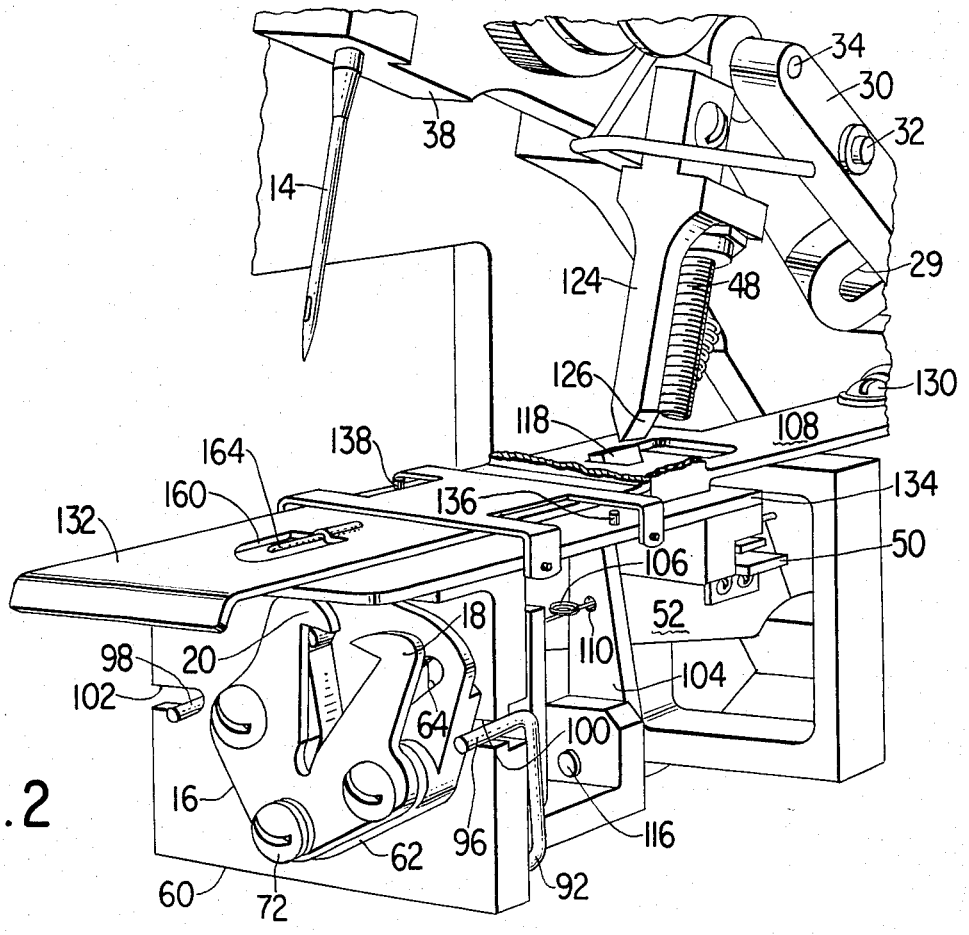
FIGS. 2 and 3 are fragmentary perspective views of the machine.
Figure 3:
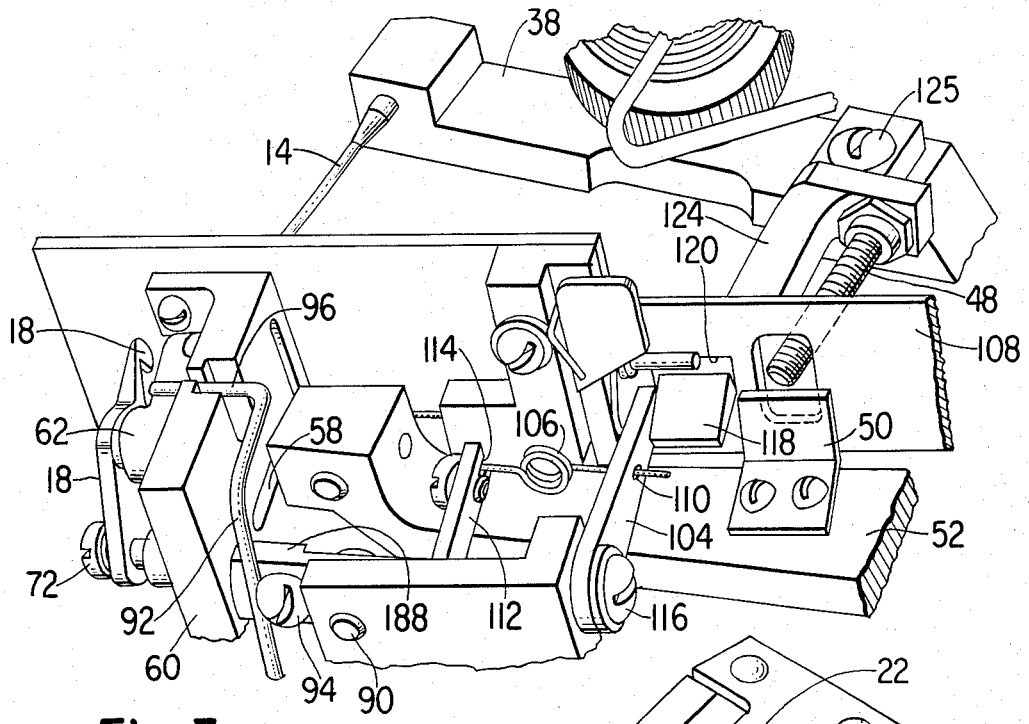
Figure 5:
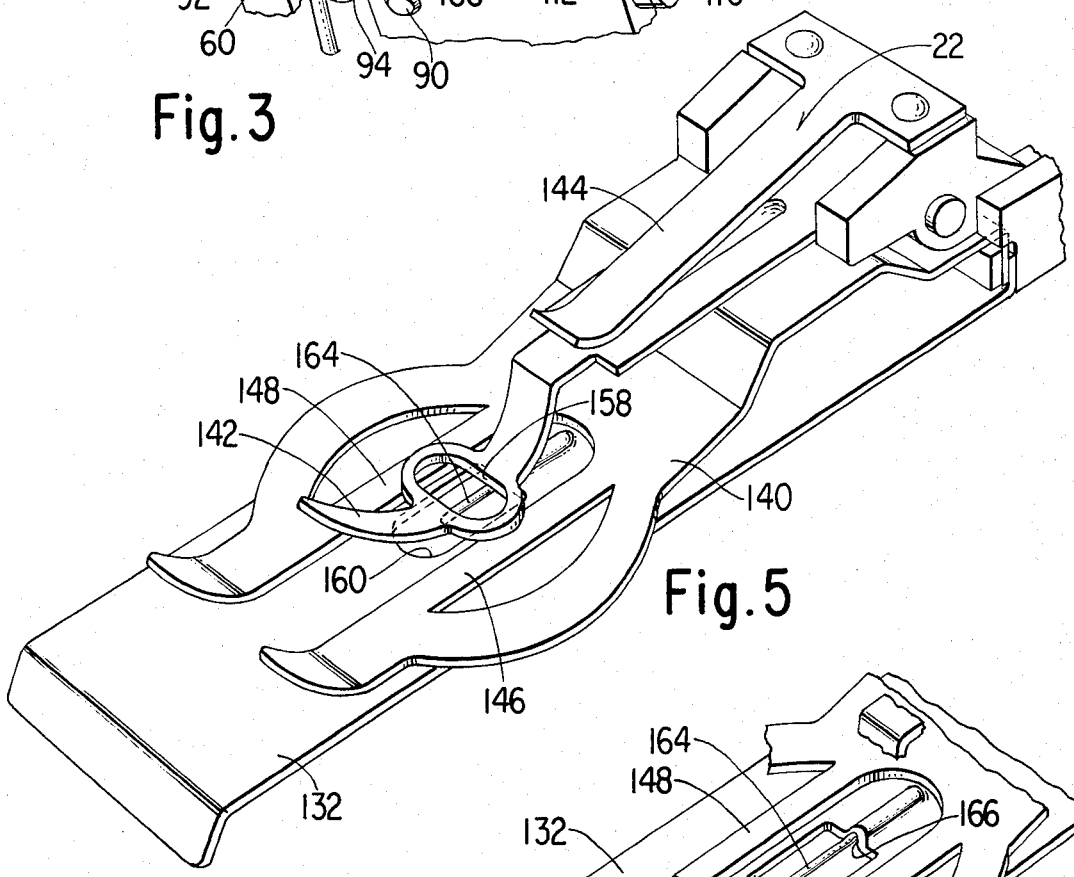
FIG. 5 is a perspective view of fabric and button clamping mechanism as provided on the machine of FIGS. 1, 2 and 3.
Figure 6:
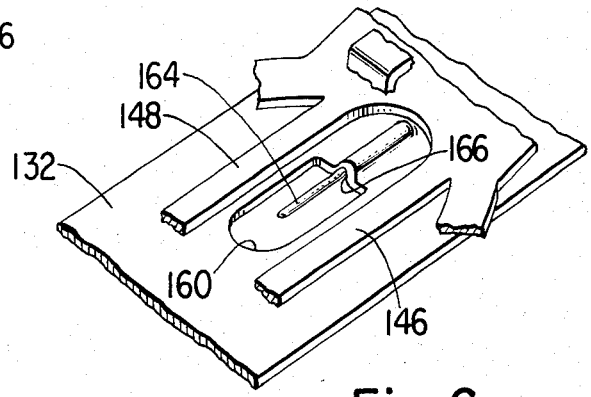
FIG. 6 is a perspective view of a portion of the mechanism shown in FIG. 5.
Figure 4:
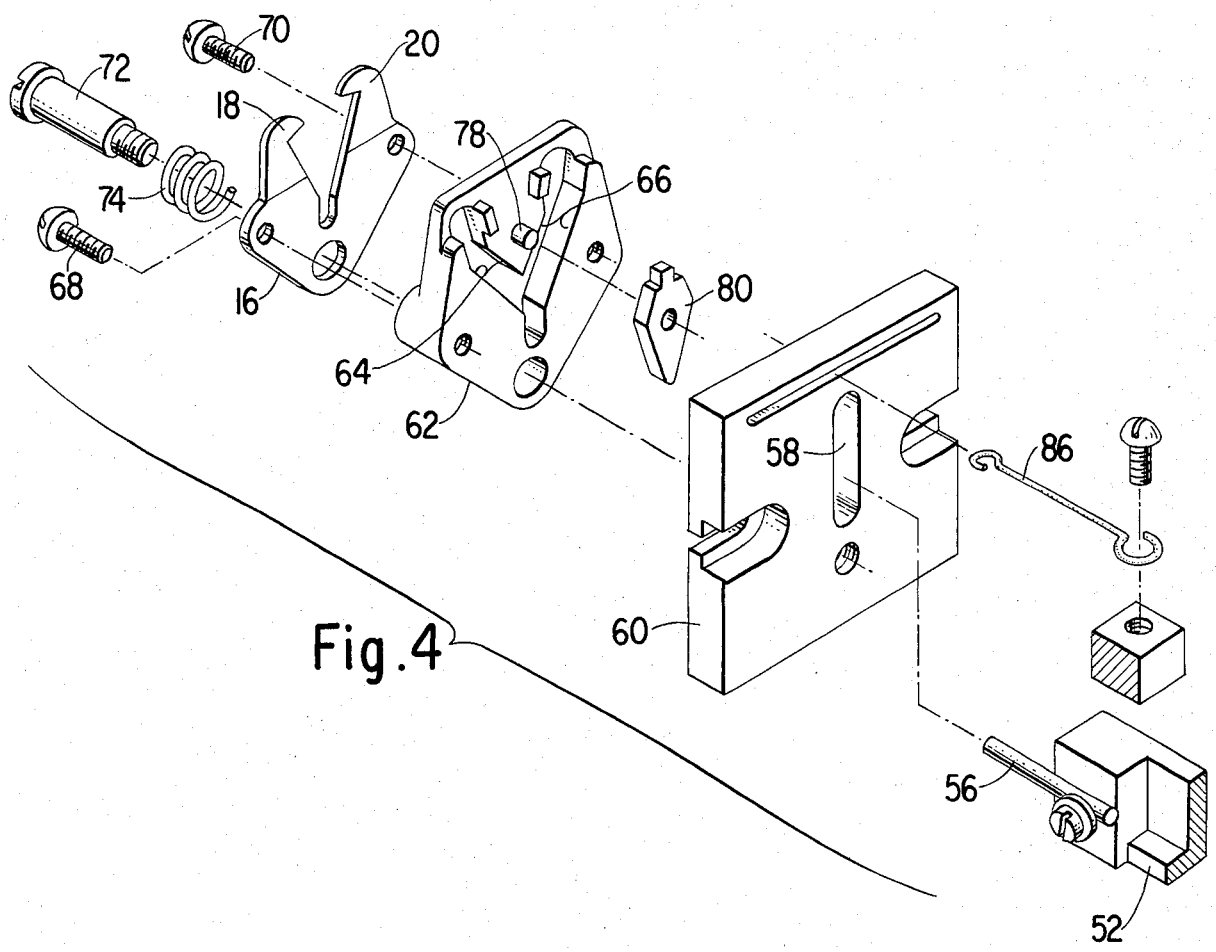
FIG. 4 is an exploded perspective view showing looper actuating mechanism as provided for the machine of FIGS. 1, 2 and 3.

Referring to the drawings, there is shown a hand held button sewing machine 10 according to the invention, including a frame 12, a thread carrying needle 14 arranged for reciprocating movement, and a pivotally movable looper 16 with opposing loop seizing points 18 and 20 which cooperate with the needle in the formation of chain stitches. A work and button clamping assembly 22 is arranged to undergo movements in cooperation with those of the needle 14 and the looper to properly position a button which is to be sewn to a work piece. A hand operated lever 26 having one end pivotally attached at 28 to the frame 12 is interconnected with the needle 14 and clamping assembly 22 to impart the desired movements thereof. The hand operated lever 26 also imparts movements to the looper 16. Machine 10, as shown in the drawings is limited for use in sewing a two hole button, but can be readily adapted to also provide for the sewing of a four hole button, as in the manner shown, for example, in the aforementioned copending patent application, Ser. No. 488,904, U.S. Pat. No. 4,474,123 of Gary W. Ponte for "Work Clamp Shifting Mechanism for Sewing Machines", filed Apr. 27, 1983, and the arrangement of the present invention as hereinafter described for sewing under and over a tongue in the needle hole of a fabric feeding plate applies to the sewing of either a two or four hole button.

As shown, lever 26 connects in a slot 29 with one end of a link 30 which is pivotally mounted on a pin 32 affixed in frame 12. A free end of link 30 includes a laterally extending pin 34 that carries a roller 36. The roller engages an arm 38 which carries needle 14 at one end and is pivotally mounted at the other end on a shaft 40 affixed in the frame 12. Arm 38 is biased upwardly by spring 42 into engagement with a stop 44 which supports a thread tensioning device 46. The arm is caused to move downwardly and dispose needle 14 for cooperation with looper 16 whenever lever 26 is squeezed upwardly. When lever 26 is released, the arm is returned to a position of engagement with stop 44 by spring 42.

Arm 38 carries a depending adjustable screw 48 which is caused during a latter portion of the descent of arm 38 to engage a flange 50 affixed to a looper drive arm 52, and move the drive arm downwardly about one end pivoted on shaft 40 against the bias of a spring 54. Spring 54 moves arm 52 upwardly as arm 38 is moved upwardly following the release of lever 26. A drive pin 56 projects outwardly from the free extremity of arm 52 and extends through a vertical pin guiding slot 58 in a guide block 60 which is rigidly attached to frame 12. Pin 56 extends beyond block 60 to engage a cam 62 along intersecting cam tracks 64 and 66 thereon. Looper 16 is affixed to cam 62 with screws 68 and 70, and the assembly is mounted on block 60 with a shouldered screw 72 and spring 74 for pivotal movement on the screw 72. Cam 62 includes a fixed pin 78 which pivotally supports a gate 80 for alternately blocking each of the two intersecting cam tracks 64 and 66 so that the drive pin 56 can slidingly engage the other track to effect pivotal motion of the looper 16 as described in U.S. Pat. No. 4,411,210, for "Actuating Mechanism for a Double Pointed Looper in a Sewing Machine", issued Oct. 25, 1983, as as required to alternately place each of the two loop seizing points 18 and 20 on the looper into cooperative association with the needle 14 to provide for the formation of chain stitches. The gate is positioned by drive pin 56 and a spring 86 in the manner fully described in the said U.S. Pat. No. 4,411,210.

Feeding mechanism is provided for reciprocating work under the needle 14. Such feeding mechanism includes a lever 88 which is pivotally mounted on a pin 90 in frame 12, and has a member 92 affixed thereon at 94. Member 92 includes fingers 96 and 98 that extend through slots 100 and 102, respectively, in block 60 to engage opposite sides of cam 62. The feeding mechanism further includes a feed pawl 104, a wire spring 106 which connects lever 88 with the feed pawl, and a carrier 108 to which the clamp assembly 22 is cemented or otherwise suitably secured. As shown, one end of spring 106 extends through a hole 110 in pawl 104 and the other end of the spring extends through a slot 114 in an upstanding end portion 112 of lever 88. The lower end of the pawl 104 is pivoted at 116 in the frame, and a wedge-shaped upper end portion 118 projects through an opening 120 in clamp carrier 108. The width of opening 120 is sufficient to accommodate the upper end portion 118 of pawl 104 as well as a depending plunger 124 which is affixed to arm 38 with a screw 125 and is movable into and out of the opening as the arm is caused to pivot on shaft 40. Plunger 124 has a lower wedge-shaped and end portion 126 as shown.

While the needle carrying arm 38 is in a raised position, the looper affixed cam 62 is in extreme pivoted position against finger 96 or 98, and lever 88 is disposed to cause spring 106 to hold end portion 118 of pawl 104 against one side or the other of opening 120 as determined by the position of the cam 62. When arm 38 is moved downwardly by the squeezing of lever 26, plunger 124 is caused to move into opening 120. As the plunger 124 moves into opening 120, wedge edge portion 126 pushes against feed pawl 104, whereupon the pawl is caused to move carrier 108 and clamping assembly 22 attached thereto about a pivotal mounting for the carrier at 130. Clamping assembly 22 includes a fabric supporting feeding plate 132 slidable on the bed 134 of the machine between stops 136 and 138. The clamping assembly also includes a resilient forked member 140 which serves to resiliently bear down on and hold fabric against plate 132, and a button clamping member 142 which is biased downwardly by a spring 144 to engage and forceably hold a button against portions 146 and 148 of the member 140. Fabric 150 and a button 152 held in the clamping assembly are moved laterally under the needle by the described movement of assembly 22, and the button is disposed for needle penetration through one buttonhole 154 of a pair of spaced buttonholes 154 and 156. Button clamping member 142, plate 132 and bed 134 include aligned openings 158, 160 and 162, respectively, through which the needle 14 can pass in laterally displaced positions of the clamping assembly.

After the initial downstroke of arm 38 and upon the release of lever 26, arm 38 is moved upwardly by spring 42 to withdraw needle 14 from the fabric 150 and buttonhole 154, and plunger 124 from opening 120. During such upward movement, looper affixed cam 62 is pivoted by drive pin 56 away from the then engaged finger on member 92, and into enforced engagement with the other finger. Lever 88 is moved to stress spring 106 in a manner causing pawl 104 to be biased against plunger 124, and when the plunger clears the pawl the stored energy in the spring is released whereupon the pawl is moved by spring action from the one side of opening 120 to the other.

During the next downstroke of arm 38 occasioned by the squeezing of lever 26, plunger 124 acts against upper portion 118 of pawl 104 on the side opposite from that engaged by the plunger during its initial downstroke. As a consequence the pawl is caused to move carrier 108 and attached clamping assembly 22 along with the fabric 150 and button 152 held thereby in a direction opposite to the direction in which they were moved during the initial downstroke, and the button is repositioned for needle penetration of the buttonhole 156 of the buttonhole pair 154 and 156.

As the arm 38 is again moved upwardly upon the release of lever 26 to thereby withdraw needle 14 from fabric 150 and buttonhole 156, and plunger 124 from opening 120, looper affixed cam 62 is pivoted by drive pin 56 away from the engaged finger on member 92 and into enforced engagement with the other finger. Lever 88 is moved to stress the spring 106 while pawl 104 is still in engagement with plunger 124 and when the plunger clears the pawl the spring moves the pawl across opening 120 to its initial position to complete an operation cycle of the machine. During repeated operating cycles of the machine button 152 is sewn by thread T to fabric 150 through buttonholes 154 and 156.

Feeding plate 132 has a tongue 164 located thereon to extend longitudinally in elongate needle hole 160 formed in the plate, and the thread T is sewn under and across this tongue as shown in FIG. 9. Tongue 164 is a stiff wire member having one end affixed in a recess 166 in plate 132 as with an epoxy cement or other suitable adhesive. The tongue is mounted in plate 132 so as to at least contact the underside of fabric 150 held against the plate (that is by member 140) and preferably protrudes above the level of the upper surface of the plate so as to raise the fabric in needle hole 16 slightly above the plane of the plate. This disposition of the needle enables the tongue to be effectively sewn to the fabric when a button sewing operation is initiated, and prevents the fabric from slipping on feeding plate 132. Since the button 152 is secured to the fabric, it cannot slip under member 142 and proper positioning of the buttonholes 154 and 156 for needle penetration is assured. By having the tongue sewn to the fabric, needle following movement of the fabric is prevented, and a neatly attached button with a requisite degree of looseness of thread, as determined by the thickness of portions 146 and 148 of member 140 defining the spacing between the button and fabric during a button sewing operation, is also assured. After the completion of a button sewing operation, the fabric and button are removed from the machine by pulling the fabric longitudinally on the feeding plate until it is free of the tongue 164.

It is to be understood that the present disclosure relates to a single embodiment of the invention which is for purposes of illustration only and is not to be construed as limiting the invention. Numerous alterations and modifications of the structure herein will suggest themselves to those skilled in the art, and all such modifications and alterations which do not depart from the spirit and scope of the invention are intended to be included within the scope of the appended claims.

I claim:

1. In a button sewing machine, a fabric supporting plate with a needle hole therein, means for clamping fabric and a button to the plate for movement thereby into positions wherein the button may be sewn to the fabric through spaced apart holes in the button, and a thread supporting tongue located on the plate in a position to extend longitudinally in the needle hole into engagement with the underside of the clamped fabric and enable thread to be sewn under and across the tongue whereby the tongue is temporarily sewn to said fabric to prevent the fabric from slipping on the supporting plate during a button sewing operation.

2. The combination of claim 1 wherein the tongue is a rigid member which is affixed to the plate at one end of the needle hole.

3. The combination of claim 2 wherein the tongue is cemented to the plate.

4. The combination of claim 2 wherein the finger protrudes above the level of the fabric supporting plate to raise the fabric at the needle hole.

5. The combination of claim 2 wherein the fabric supporting plate is recessed and the thread supporting plate is cemented to the plate in said recess.

* * * * *